US005398817A

United States Patent [19]

Connolly et al.

[11] Patent Number: 5,398,817

[45] Date of Patent: Mar. 21, 1995

[54] CENTER RETAINER ASSEMBLY FOR PANEL MOUNTING SYSTEM

[75] Inventors: James D. Connolly; Robert E. Henry, Jr., both of Princeton, W. Va.

[73] Assignee: Conn-Weld Industries, Inc., Princeton, W. Va.

[21] Appl. No.: 202,012

[22] Filed: Feb. 25, 1994

[51] Int. Cl.[6] ..... B07B 1/49

[52] U.S. Cl. ..... 209/399; 209/403; 209/405

[58] Field of Search ..... 209/399, 405, 408, 412, 209/403, 395; 52/762, 772, 460, 461, 464, 468; 160/327, 391

[56] References Cited

U.S. PATENT DOCUMENTS 4,059,933 11/1977 Funk et al. ..... 52/464 X
5,112,475 5/1992 Henry, Jr. .
5,277,319 1/1994 Henry, Jr. .

*Primary Examiner*—David H. Bollinger
*Attorney, Agent, or Firm*—Jones, Tullar & Cooper

[57] ABSTRACT

A center retainer assembly for a panel mounting system of a vibrating screen utilizes an elongated bolting bar which is encased in a resilient material that includes an elongated center retainer. The bolting bar and its encasing resilient material are situated in a channel portion of an upwardly facing retainer channel. The retainer channel is, in turn, secured by way of a mounting plate to a cross tube of the vibrating screen apparatus.

14 Claims, 5 Drawing Sheets

CENTER RETAINER ASSEMBLY FOR PANEL MOUNTING SYSTEM

FIELD OF THE INVENTION

The present invention is directed generally to a center retainer assembly for a panel mounting system. More particularly, the present invention is directed to a bolt-in center retainer assembly for a panel mounting system. Most specifically, the present invention is directed to a bolt-in center retainer assembly for mounting screen panels in a vibrating screening apparatus. Screen panels are held along their edges by elongated, center retainers. These center retainers are molded from a resilient material such as polyurethane and are formed having an elongated bolting bar integrally molded into the retainer section. This bar carries a plurality of securement studs. The polyurethane center retainer with its incorporated bolting bar is positioned in an inverted retainer channel. This retainer channel is, in turn, welded to a mounting plate that is securable to a cross tube in a vibrating screen assembly.

DESCRIPTION OF THE PRIOR ART

Vibrating and other separatory screen assemblies are generally known in the art and are very useful in accomplishing the separation of materials on the basis of size of the materials to be separated. A slurry of liquid and entrained solids will be caused to run or flow across an upper surface of a screen panel assembly. Particles of a certain size and above will not pass through apertures in the screen panels and will thus be separated out. The screen panel assembly is caused to vibrate by any suitable means with this vibratory motion being beneficial in facilitating the proper separation of the material directed to the screen panel.

One such vibratory screen panel assembly is shown in U.S. Pat. Nos. 5,112,475 and 5,277,319, both the Henry, and both assigned to Conn-Weld Industries, the assignee of the present application. In these two patents, there is disclosed a panel mounting system for a vibrating screen assembly, and a panel which is securable in the vibrating screen assembly using the panel mounting system. A plurality of screen panels are secured to a panel deck of a frame portion of a vibrating screen assembly. A plurality of elongated hold downs or center retainers, which are made of a resilient elastomeric material, such as polyurethane, are provided with spaced anchoring pins along their bottom surface. These anchoring pins are receivable in apertures in an anchor member. Once the hold down members or center retainers have been secured to the anchor member, which is, in turn, attached to spaced cross members or tubes of the frame of the vibratory separator, the screen panels are placed atop the panel deck with their side edges in contact with the center retainers. Elongated key members are inserted into upwardly facing slots in the center retainers to spread wing portions of the retainers laterally outwardly. This spreading of the wings of the center retainers causes the wings to grip the side edges of the screen panels so that these panels are secured in the vibrating screen assembly.

While the panel mounting system disclosed in the two above-referenced patents has operated very well and has been widely acknowledged as a significant advance in the art, it has become apparent that various improvements in the system would render the system even more effective as well as easier to use. In the prior system, it may be possible to mis-align the anchoring pins on the bottom of the center retainer members with the apertures in the top of the anchor members which are secured to the cross-members or cross tubes of the frame. Such a possible mis-alignment may make anchor pin insertion more difficult than it otherwise would be. It is also possible that the anchor pins on the underside of the elongated polyurethane center retainers may loosen in their engagement with the apertures in the elongated anchor members. Such loosening may result in a diminished mounting effectiveness of the screen panels on the panel deck.

The panel mounting system disclosed in the two above-referenced Henry patents, which are assigned to Conn-Weld Industries, utilizes screen panels and cooperating anchor members which are bolted, welded or otherwise secured to cross members of the panel deck of the vibrating screen assembly. An owner of a vibrating screen apparatus which is not provided with the appropriate anchor members disclosed in the prior Henry patents must make substantial revisions and modifications to his vibrating screen assembly if he is to be able to enjoy the advantages of the Conn-Weld Industries panel mounting system.

It will thus be seen that a need exists for an improved panel mounting system. The center retainer assembly in accordance with the present invention provides such a system and is a significant improvement over the prior art system.

SUMMARY OF THE INVENTION

It is an object of the present invention to provide a center retainer assembly for a panel mounting system.

Another object of the present invention is to provide a bolt-in center retainer assembly for a panel mounting system.

A further object of the present invention is to provide a bolt-in center retainer assembly for mounting screen panels in a vibrating screen system.

Yet another object of the present invention is to provide a center retainer assembly which is easy to install.

Still a further object of the present invention is to provide a bolt-in center retainer assembly for a panel mounting system which is easily replaced.

Even yet another object of the present invention is to provide a center retainer assembly for a panel mounting system which is usable with a variety of vibrating screen assemblies.

As will be discussed in detail in the description of the preferred embodiment which is set forth subsequently, the center retainer assembly in accordance with the present invention is usable in a vibrating screen panel assembly to secure screen panels to the panel deck of the vibrating screen assembly. An elongated bolting bar has a plurality of longitudinally spaced, threaded bores. Suitable stud bolts have first ends threaded, welded or otherwise secured in these bores. The bolting bar and its stud bolts are positionable within an inverted retainer channel with second ends of the bolts passing down through apertures in the web of the retainer channel. A suitable resilient, elastomeric material, such as polyurethane is cast around the bolting bar and stud bolts in the shape of the cavity formed by the inverted retainer channel. The polyurethane is also cast or molded having an upper surface formed in the shape of the center retainer or hold down disclosed in the Henry U.S. Pat. Nos. 5,112,475 and 5,277,319 which are assigned to Conn-Weld Industries. The now completed center retainer assembly can be used as a mounting assembly for screen panels either by welding of the retainer channel to spaced mounting plates which are, in turn, bolted to a cross tube through the use of U-bolts and pipe saddles, if the center retainer assembly is to be used in the Conn-Weld Industries screen assembly; or by welding the retainer channel to a mounting strip that is, in turn welded to a cross tube cover which is positioned atop a cross tube in a vibratory screen assembly made by others.

The center retainer assembly in accordance with the present invention provides a one piece assembly which includes both the elongated, resilient hold down or center retainer and also its retainer channel. This ensures that the elongated resilient center retainer is properly located in, and securely attached to, the retainer channel, and that it can be attached as a unit either to the cross tube of a Conn-Weld Industries vibrating screen assembly or to the cross tube of another manufacturer's screen assembly.

The elongated, resilient center retainer provides all of the benefits of the panel mounting system described in the two previously referenced Henry patents, while at the same time providing increased ease of installation, improved holding capability, and ease of replacement or removal. The bolting bar is provided with stud bolts at spaced locations and these studs pass through apertures in the retainer channel. Once the polyurethane has been cast around the bolting bar and stud bolts and fills the upward facing retainer channel, suitable nuts are placed on the ends of the stud bolts which pass through the retainer channel and are used to further secure the bolting bar in the inverted retainer channel. The elongated, center retainer with its resilient wings, is formed as an integral part of the center retainer assembly. Once the bolt-in center retainer assembly is secured to the cross tubes of a vibrating screen assembly, it provides a one piece member that will receive and hold the edges of individual screen panels in a secure, accurate manner.

The center retainer assembly for a panel mounting system in accordance with the present invention provides an improved panel mount and retainer. It is a substantial advance in the art.

BRIEF DESCRIPTION OF THE DRAWINGS

While the novel features of the center retainer assembly for a panel mounting system in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
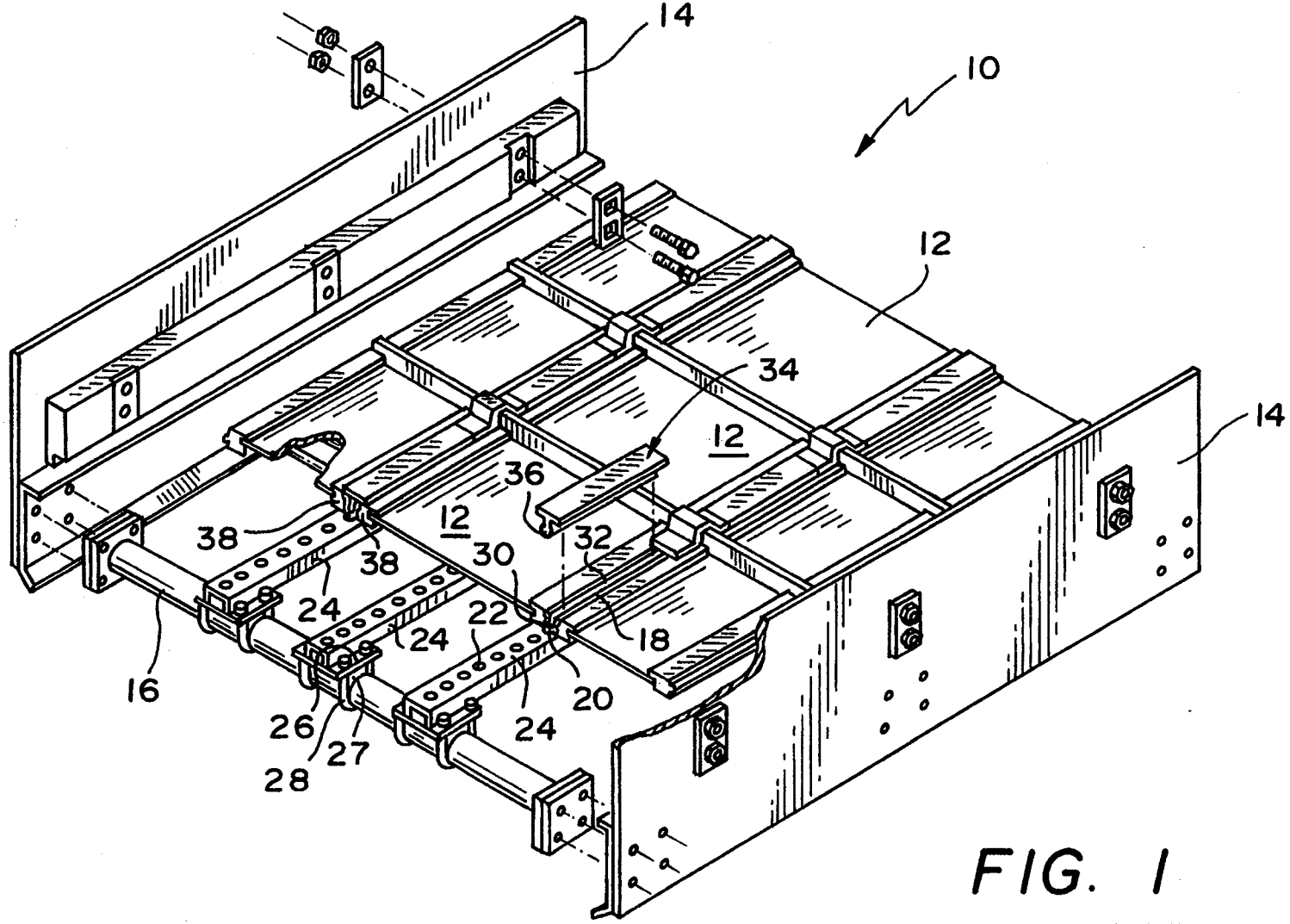
FIG. 1 PRIOR ART
FIG. 1 is a perspective view of a prior art vibrating screen assembly.

Referring initially to FIG. 1, there may be seen generally at 10 a prior art vibratory screen assembly with which the center retainer assembly in accordance with the present invention is particularly beneficially employed. The vibratory screen assembly, generally at 10 in FIG. 1, is set forth in detail in prior U.S. Pat. Nos. 5,112,475 and 5,227,319, both of which are assigned to Conn-Weld Industries, Inc., the assignee of the subject application. The disclosures of these two patents are incorporated herein by reference.

As disclosed in detail in these two prior patents, the vibratory screen assembly 10, with which the present invention finds beneficial use, utilizes a panel mounting system that is used to secure a plurality of screen panels 12 between side plates 14, with the side plates being separated by a plurality of cross tubes 16, only one of which is shown .in FIG. 1. A plurality of resilient, elongated flexible center retainers or hold down members 18 have downwardly extending anchoring pins 20 which are insertable in apertures 22 in anchor members 24. These anchor members 24 are, in turn, secured to the cross tubes 16 by use of mounting plates 26, pipe saddles 27 and associated U-bolts 28. As described in detail in the two prior Conn-Weld Industries patents, each of the elongated center retainers or hold downs 18 has a central pocket or groove 30 which is defined by spaced wings 32. An elongated key member 34 has a tongue 36 which is sized to be receivable in pocket 30 and acts to spread wings 32 laterally outwardly toward the side walls 14 of the panel assembly. Each of the screen panels 12 has sides with elastomeric borders 38. These screen panel borders 38 are shaped to cooperate with the wings 32 of the elongated center retainers or hold down members 18. Once the screen panels 12 have been placed atop the panel deck of the vibrating screen assembly 10 with their side edges 38 in cooperation with the wings 32, the key members 34 can be inserted into the pockets 30 of the center retainers 18 to bias the wings 32 outwardly thereby holding the screen panels 12 in place.

The center retainer assembly in accordance with the present invention as will now be discussed in detail, is intended as a replacement for the elongated hold downs 18, the anchoring pins 20 and the anchor members 24 of the prior panel mounting system described briefly above, and in greater detail in the previously referenced Henry patents. The center retainer assembly of the present invention is usable to secure screen panels 12 having elastomeric borders 38 to the panel deck of the vibrating screening apparatus using the key members 34 previously discussed. It will thus be understood that other than to the extent to be described hereinafter, the panel mounting assembly disclosed and described in the two Henry patents is usable in the center retainer assembly in accordance with the present invention.

Figure 2:
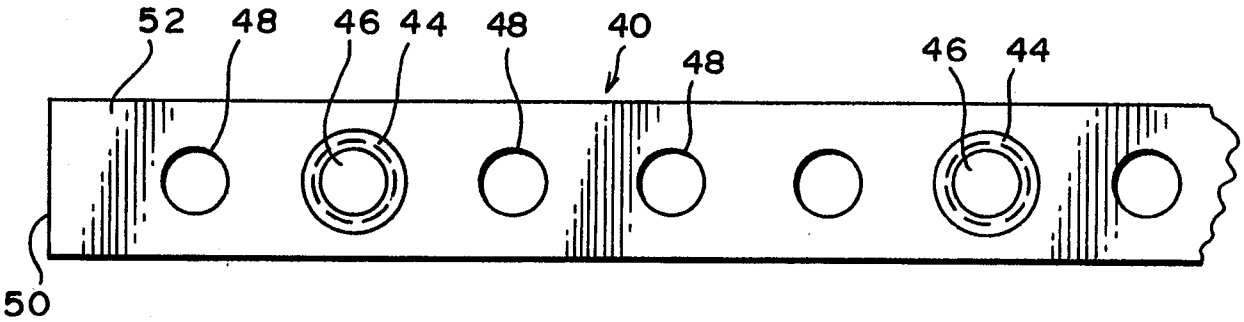
FIG. 2 is a top plan view of a bolting bar in accordance with the present invention.
Figure 3:
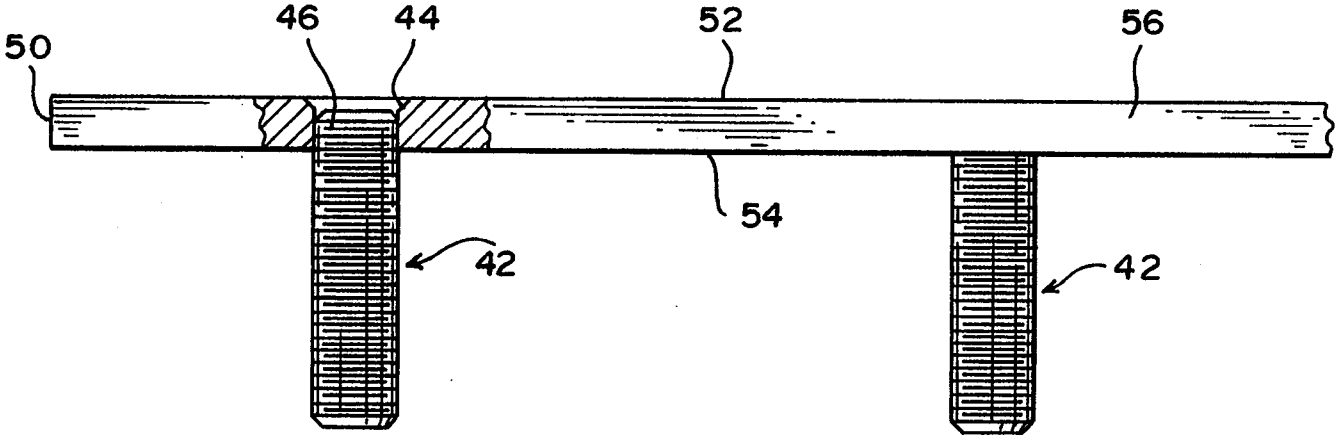
FIG. 3 is a side elevation view of the bolting bar shown in FIG. 2 with its stud bolts in place.
Figure 4:
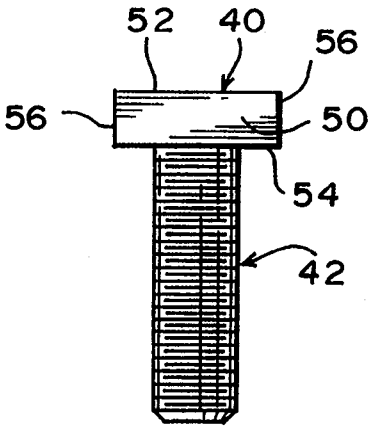
FIG. 4 is an end view of the bolting bar and stud bolts shown in FIG. 3.

Turning now initially to FIG. 2, the center retainer assembly of the present invention utilizes an elongated bolting bar, generally at 40 to receive a plurality of stud bolts 42. The bolting bar 40 has a plurality of longitudinally spaced, chamfered, threaded bores 44, each of which, as seen most clearly in FIG. 3 receives a first or upper end 46 of a threaded stud bolt 42. A plurality of longitudinally spaced, non-threaded openings 48 are located in the bolting bar 40 between the threaded bores 44, and are also located intermediate the threaded bores 44 and ends 50 of the bolting bar. As may be seen most clearly in FIG. 4, bolting bar 40 is preferably generally rectangular in cross-section and has a top surface 52, a bottom surface 54, spaced sides 56, and the ends 50 previously discussed. In the preferred embodiment, the bolting bar is ½ inch thick by 1½ inches wide. The length of the preferred embodiment bolting bar is 47.5 inches. Each of the stud bolts is 3 inches long. It will be understood that these dimensions are merely exemplary and that they could be varied in accordance with the size of the vibrating screen panels and panel deck with which the center retainer assembly in accordance with the present invention is to be used.

Figure 6:
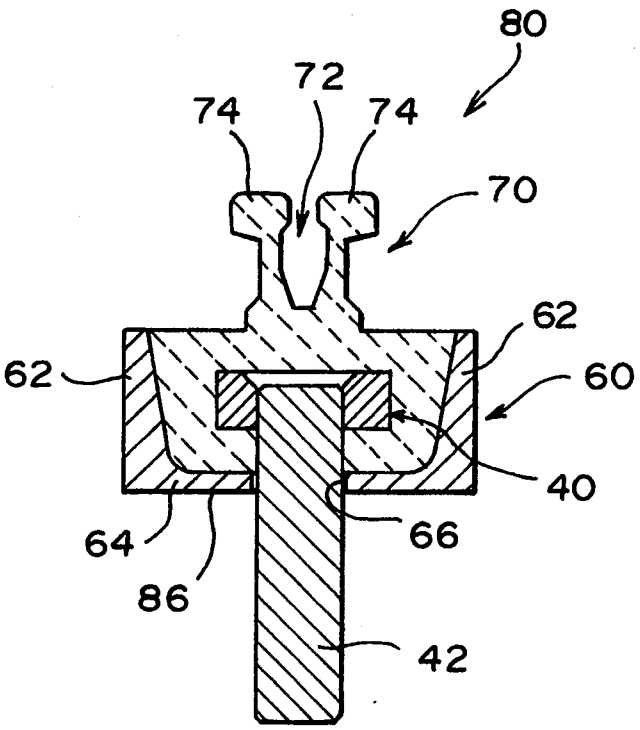
FIG. 6 is a cross-sectional view of the center retainer assembly taken along line VI—VI of FIG. 5.
Figure 5:
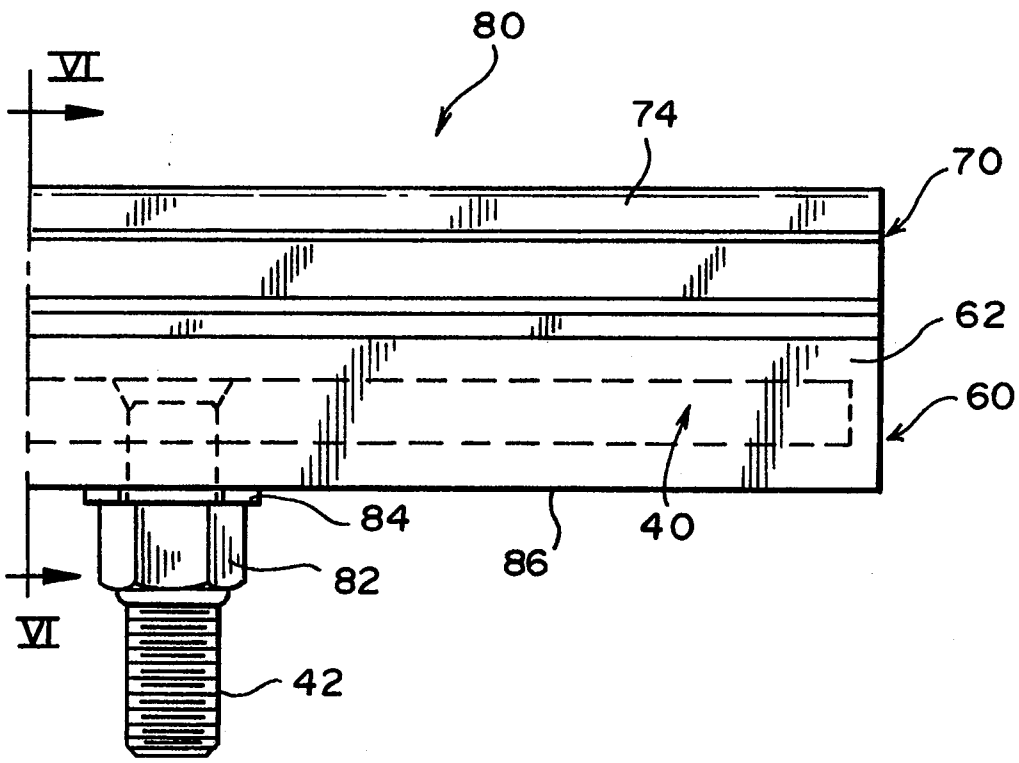
FIG. 5 is a partial side elevation view of a center retainer assembly of the present invention.

After the bolting bar 40 and its associated stud bolts 42 have been assembled by first screwing the first, upper ends of the stud bolts into the threaded bores 44 of the bolting bar, and by then welding the stud bolts in the bolting bar to prevent further rotation of the bolts 42 in the bar 40, the resultant bar and bolt assembly is cast in a resilient elastomeric material, such as polyurethane. This may be done while the bar and bolt assembly is positioned in a retainer channel, generally at 60, as seen in FIGS. 5 and 6. The retainer channel is a generally upwardly facing or inverted steel channel that has upstanding side walls 62 and a bottom web 64. A plurality of stud bolt apertures 66 are formed in the bottom web 64 of the inverted retainer channel 60. These allow second, lower ends of the stud bolts 42 to extend down beneath the bottom web 64 of the inverted retainer channel 60.

The bolting bar 40 and its stud bolts 42 may be positioned within the cavity defined by the upward facing retainer channel 60 and with the second, lower ends of the stud bolts 42 passing down through the stud bolt apertures 66 in the retainer channel web 64. The bolting bar 40 will be held in this orientation in the retainer channel 60 by any suitable, generally conventional manner and the top of the retainer channel can be covered with a suitable cavity mold that has the negative of the shape of the center retainer of the present mounting system. As seen most clearly in FIG. 6, and as has been described previously, the elongated center retainer, now indicated at 70 in FIGS. 5 and 6, has a central pocket 72 which is defined by spaced, upwardly extending wings 74. The central pocket 72 is shaped to receive the tongue 30 of the key member 34, as seen in FIG. 1, while the exterior surfaces of the wings 74 are shaped to cooperate with the elastomeric borders 38 of the screen panels 12. The specific cavity mold and its support means are not described since they are generally conventional.

A suitable resilient elastomeric material, such as polyurethane may be introduced into the cavity mold and will be cast into the shape of the center retainer shown in FIG. 6. As the polyurethane enters the upwardly facing chamber of the inverted retainer channel 60, it will pass through the non-threaded openings 48 in the bolting bar 40 which are provided to ensure that the entire channel portion of the retainer channel 60 is filled, in a void free manner, with polyurethane. Once the polyurethane or other resilient elastomeric material has been cast and has hardened, the cavity mold can be removed to provide a resilient bolt-in center retainer in accordance with the present invention, and which is now identified generally at 80 in FIG. 6.

It is also possible, in accordance with the present invention to utilize a separate mold to form the polyurethane center retainer 70 with its included bolting bar 40 and associated stud bolts 42 separate from the inverted retainer channel 60. In this instance, the negative mold has a mold cavity which includes the shape of the center retainer 70 as well as the shape of the interior channel portion of the inverted retainer channel 60. Once the polyurethane or other elastomeric material had been cast into proper shape about the bolting bar 40 and the stud bolts 42 suspended within the mold, the hardened polyurethane member can be removed from the mold and placed in the awaiting retainer channel 60.

Figure 8:
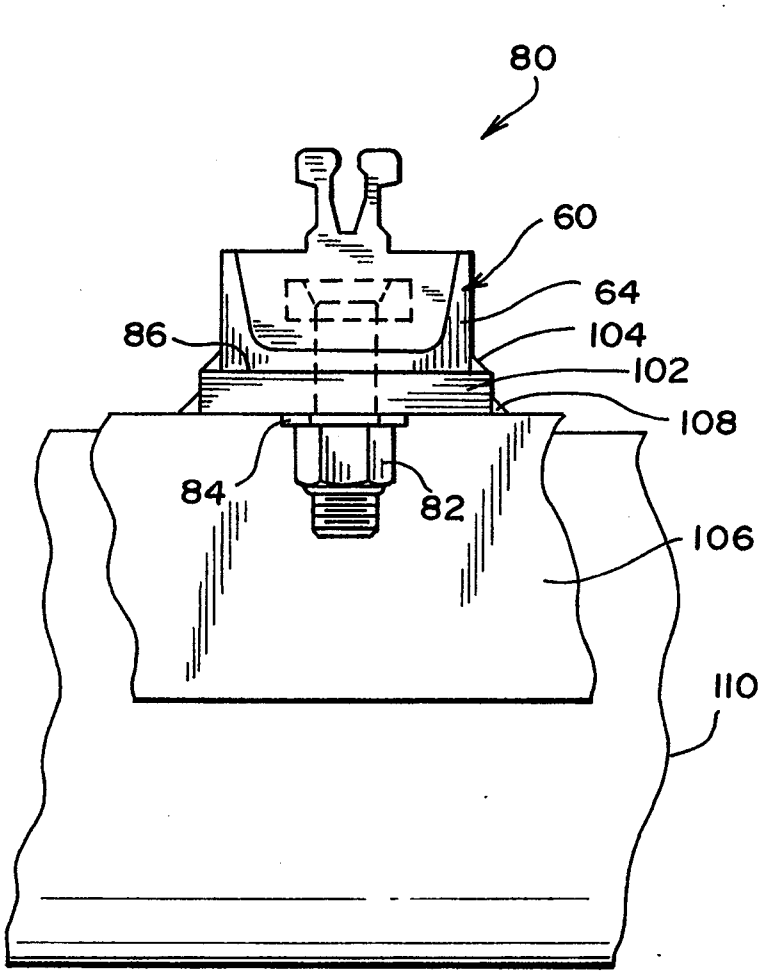
FIG. 8 is an end view of the center retainer assembly of the present invention secured to an industry standard cross tube of a screen panel.
Figure 10:
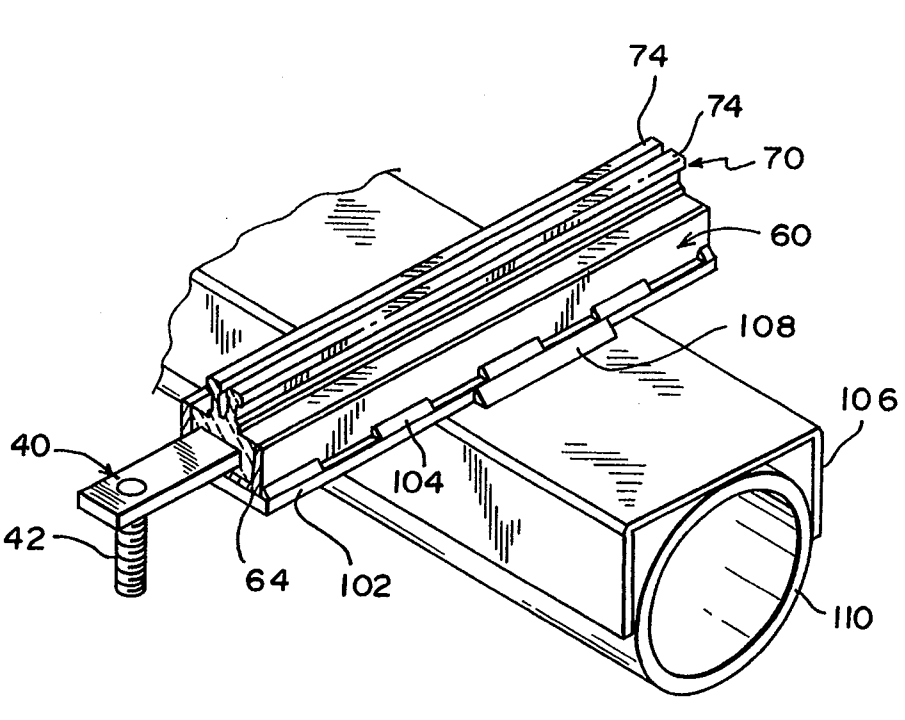
FIG. 10 is a perspective view of the center retainer assembly and its securement to a cross tube as depicted in FIG. 8.

Once the bolt-in center retainer 80 in accordance with the present invention, as depicted in FIG. 6, has been removed from its forming mold, a suitable nut 82 and an associated washer 84 may be threaded onto each of the shanks of the stud bolts 42. These nuts 82 and washers 84 positively secure the bolting bar 40 and its surrounding polyurethane molded componentry, including the elongated center retainer member 70 in the channel or recess in the inverted retainer channel 60. As seen in FIG. 5, each nut 82 and its washer 84 may be screwed up along the shank of an associated stud bolt 42 until the washer firmly engages a bottom face 86 of the bottom web 64 of the retainer channel 60, as seen in FIG. 5, when the center retainer assembly is used in a Conn-Weld Industry vibratory screen panel assembly. In this configuration, as may be seen in FIGS. 7 and 9, and as will be discussed in detail subsequently, the center retainer assembly is then provided with spaced mounting plates which will align with the cross tubes of the panel deck. In an alternative arrangement, as seen in FIGS. 8 and 10, when the center retainer assembly is to be used with an industry standard vibratory screen panel assembly in which the spacing of the various cross tubes may vary, the nuts 82 and washers 84 are screwed up along the shanks of the stud bolts 42 into engagement with an elongated mounting strip which extends along the length of the bottom web 64 of the retainer channel 60. This is shown in FIG. 8 and will be discussed in detail hereinafter. The resultant bolt-in center retainer member 80 is a one piece unit which includes the elongated center retainer 70 that is usable in the securement of screen panels 12 to the vibrating screen assembly 10, the inverted retainer channel 60 which takes the place of the separate anchor member 24 shown in the prior art device depicted in FIG. 1, and which also includes spaced mounting plates or an elongated mounting strip, as will now be discussed in detail.

Figure 7:
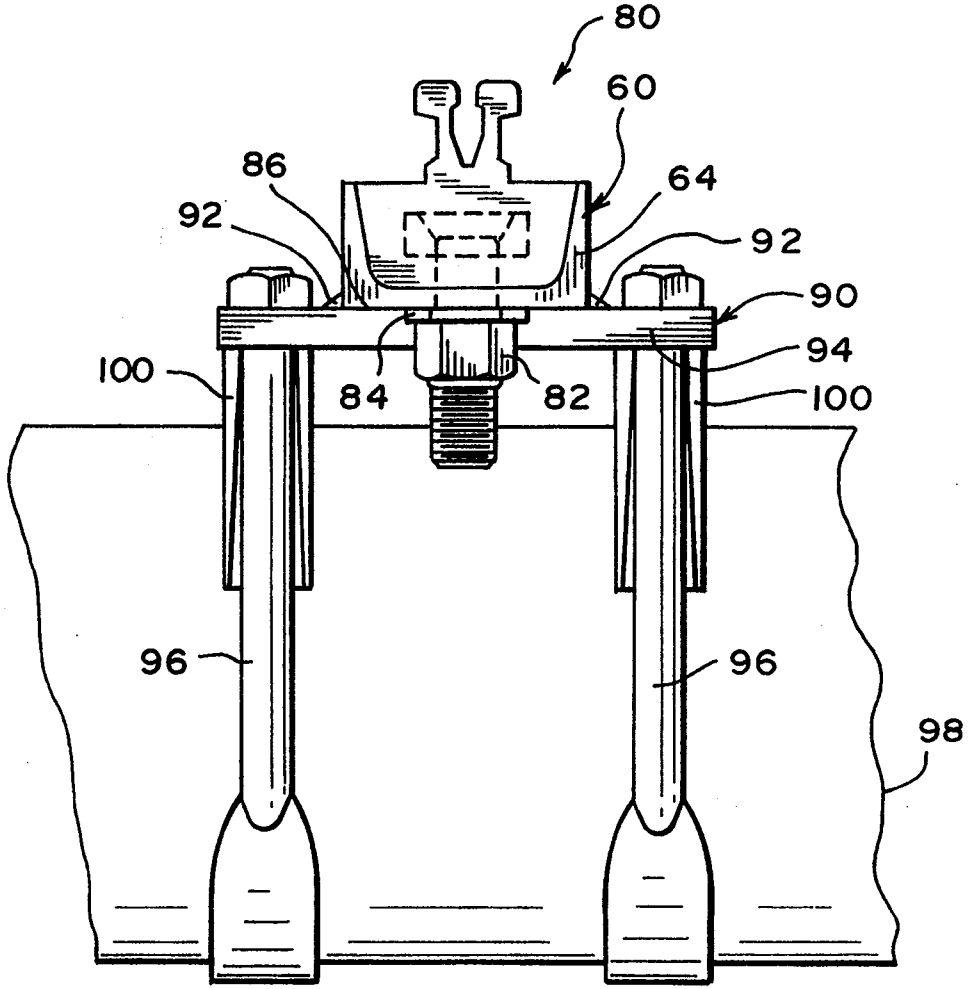
FIG. 7 is an end view of the center retainer assembly of the present invention secured to a cross tube of a Conn-Weld Industries screen assembly.
Figure 9:
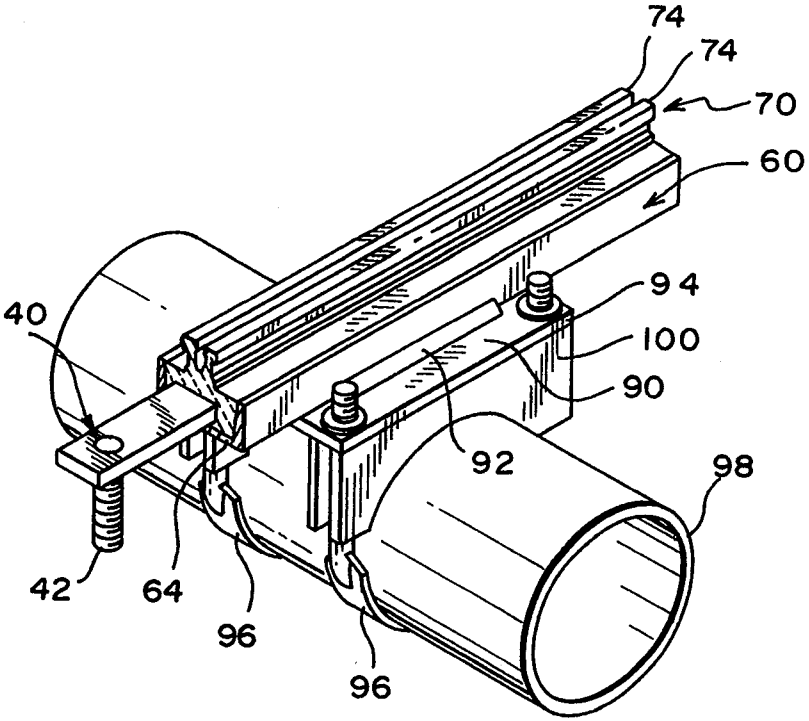
FIG. 9 is a perspective view of the center retainer assembly and its placement atop a cross tube generally as depicted in FIG. 7.

Turning now to FIGS. 7 through 10, the use of the bolt-in center retainer member 80 in accordance with the present invention in use with a Conn-Weld Industries E-Z Deck frame is shown in FIGS. 7 and 9, and in use with an industry standard frame, as shown in FIGS. 8 and 10, respectively may be seen. Referring initially to the Conn-Weld installation, the bolt-in center retainer member, generally at 80, is provided with a plurality of longitudinally spaced and laterally extending mounting plates, such as the one which is shown at 90 in FIGS. 7 and 9. Each such mounting plate 90 is attached to the bottom face 86 of the retainer channel bottom web 64 by suitable weldments, depicted schematically at 92. Each mounting plate 90 has laterally extending flanges 94 which are suitably apertured to receive free upper ends of U-bolts 96 that are used to secure the mounting plate 90 atop a cross tube 98 by use of conventional pipe saddles 100. These mounting plates 90, U-bolts 96, and pipe saddles 100 are generally the same as those depicted in the prior art device shown in FIG. 1 and discussed in the prior Henry patents. In the subject invention, the mounting plates 90 are welded to the inverted retainer channel 60 thereby providing an even more solid retainer for engaging and holding the screen panels whose elastomeric edges will abut the exterior surfaces of the wings 74 of the elongated hold down portions 70 of the center bolt-in retainer 80 in accordance with the present invention. The spacing of the welded mounting plates 90 is dictated by the spacing of the cross tubes 16. Since this spacing is known, the mounting plates can be accurately positioned during fabrication of the center retainer 80.

If the bolt-in center retainer 80 of the present invention is to be used with an industry standard frame, as shown in FIGS. 8 and 10, the bottom face 86 of the retainer channel bottom web 64 of the bolt-in central retainer 80 is welded to a suitably sized mounting strip 102 by suitable weldments 104. The mounting strip 102 has suitably spaced apertures through which the shanks of the stud bolts 42 pass, as seen in dashed lines in FIG. 8. As also may be seen in FIG. 8, the nuts 82 and their associated washers 84 engage the lower face of the mounting strip 102. The use of an elongated continuous mounting strip 102 is necessary to accommodate various cross tube spacings in different vibrating screen assemblies. The mounting strip 102 is, in turn, welded to a conventional cross tube cover 106 by weldments 108. The cross tube cover 106 is secured to its associated cross tube 110, typically by welding, in a generally conventional manner. In both the mounting configuration shown in FIGS. 7–10, it will be understood that the mounting plates 90 or the mounting strip 102 are secured to the inverted retainer channel 60. It will also be understood that the stud bolts 42 do not contact the cross tubes 98 or 110 and are not required for the attachment of the bolt-in center retainer 80 to the mounting plate 90. Their purpose is, as was discussed previously, to hold the bolting bar 40, and the polyurethane or other resilient elastomeric material which surrounds it, in the upwardly facing channel 60 in accordance with the present invention.

The center retainer assembly in accordance with the present invention provides an improved mounting assembly for use in the attachment of screen panels to a panel deck in a vibrating screen assembly in a manner which is strong, secure, easy to assemble and also easy to remove. The center retainer assembly will not become loose or disconnected from the cross tubes and provides great flexibility in allowing the utilization of the panel mounting system disclosed in the prior Henry patents with Conn-Weld Industries vibrating screen assemblies as well as facilitating the use of the Conn-Weld screen mount with industry standard vibrating screen assemblies.

While a preferred embodiment of a center retainer assembly for a panel mounting system in accordance with the present invention has been set forth fully and completely hereinabove, it will be apparent to one of skill in the art that a number of changes in, for example, the overall size of the assembly, the types of screen panels used, the size of the vibrating screen assembly and the like may be made without departing from the true spirit and scope of the present invention which is accordingly to be limited only by the following claims.

We claim:

1. A center retainer assembly usable to secure screen panels to a panel deck in a vibrating screen assembly, said center retainer assembly comprising:

an elongated bolting bar;

a plurality of stud bolts secured to said bolting bar;

an elongated retainer channel having an apertured bottom web and an upwardly facing chamber, said bolting bar being positioned in said chamber with said stud bolts passing through said apertured bottom web;

a resilient material formed about said bolting bar and received in said chamber, said resilient material including an elongated center retainer; and means to secure said elongated retainer channel to a cross tube of a vibrating screen assembly.

2. The center retainer assembly of claim 1 wherein said elongated bolting bar includes a plurality of spaced apertures and further wherein first ends of said stud bolts are received in selected ones of said spaced apertures.

3. The center retainer assembly of claim 2 further including securement nuts secured to second ends of said stud bolts.

4. The center retainer assembly of claim 1 wherein said retainer channel is an inverted steel channel having spaced side walls and said bottom web, said steel channel forming said upwardly facing chamber.

5. The center retainer assembly of claim 2 wherein said elongated bolting bar is generally rectangular in cross-section and further wherein said apertures are longitudinally spaced along said elongated bolting bar.

6. The center retainer assembly of claim 1 wherein said elongated center retainer is formed on an upper surface of said resilient material.

7. The center retainer assembly of claim 6 wherein said center retainer includes a central elongated pocket and laterally spaced, upwardly extending wings.

8. The center retainer assembly of claim 7 further including a key member receivable in said central pocket of said center retainer.

9. The center retainer assembly of claim 1 wherein said resilient material is elastomeric.

10. The center retainer assembly of claim 1 wherein said means to secure said retainer channel to a cross tube includes at least one mounting plate.

11. The center retainer assembly of claim 10 wherein said mounting plate is secured to said bottom web of said retainer channel.

12. The center retainer assembly of claim 10 wherein said mounting plate is securable to a cross tube by use of spaced pipe saddles and U-bolts.

13. The center retainer assembly of claim 10 wherein said mounting plate is securable to a cross tube by attachment to a cross tube cover which is securable to a cross tube.

14. The center retainer assembly of claim 9 wherein said elastomeric material is polyurethane.

* * * * *